US011624171B2

(12) United States Patent
Zhao et al.

(10) Patent No.: US 11,624,171 B2
(45) Date of Patent: Apr. 11, 2023

(54) ENGINEERING MACHINERY EQUIPMENT, AND METHOD, SYSTEM, AND STORAGE MEDIUM FOR OPERATION TRAJECTORY PLANNING THEREOF

(71) Applicant: Baidu USA LLC, Sunnyvale, CA (US)

(72) Inventors: Jinxin Zhao, Sunnyvale, CA (US); Liangjun Zhang, Sunnyvale, CA (US); Liyang Wang, Sunnyvale, CA (US)

(73) Assignee: Baidu USA LLC, Sunnyvale, CA (US)

( * ) Notice: Subject to any disclaimer, the term of this patent is extended or adjusted under 35 U.S.C. 154(b) by 348 days.

(21) Appl. No.: 16/944,895

(22) Filed: Jul. 31, 2020

(65) Prior Publication Data

US 2022/0034071 A1 Feb. 3, 2022

(51) Int. Cl.
*E02F 9/26* (2006.01)
*E02F 9/20* (2006.01)
(Continued)

(52) U.S. Cl.
CPC ..... *E02F 9/265* (2013.01); *E02F 9/2025* (2013.01); *E02F 9/2033* (2013.01);
(Continued)

(58) Field of Classification Search
CPC ... E02F 3/32; E02F 3/437; E02F 3/439; E02F 9/2025; E02F 9/2033; E02F 9/2041; E02F 9/205; E02F 9/262; E02F 9/265
See application file for complete search history.

(56) References Cited

U.S. PATENT DOCUMENTS 6,363,632 B1 4/2002 Stentz et al.
11,401,684 B2 * 8/2022 Berry ..... E02F 3/434
(Continued)

FOREIGN PATENT DOCUMENTS

CN 1651666 A 8/2005
CN 107794967 A 3/2018
(Continued)

OTHER PUBLICATIONS

Chinese Office Action dated Apr. 1, 2022 for Chinese Patent Application No. 202110274800.2.

*Primary Examiner* — Tyler J Lee
(74) *Attorney, Agent, or Firm* — Knobbe, Martens, Olson & Bear, LLP

(57) ABSTRACT

The present disclosure discloses an engineering machinery equipment, and a method, system, and storage medium for operation trajectory planning thereof, and relates to the field of artificial intelligence, automatic control, and engineering machinery technologies. A method can include: acquiring three-dimensional sensing data of a material pile, to construct a three-dimensional model of the material pile based on the three-dimensional sensing data; determining a loading operation position of the engineering machinery equipment on the material pile based on the three-dimensional model of the material pile and structural design information of the engineering machinery equipment; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

17 Claims, 4 Drawing Sheets

(51) Int. Cl.
*E02F 3/32* (2006.01)
*E02F 3/43* (2006.01)

(52) U.S. Cl.
CPC ..... *E02F 9/2041* (2013.01); *E02F 3/32* (2013.01); *E02F 3/439* (2013.01)

(56) References Cited

U.S. PATENT DOCUMENTS

| | | | | |
|---|---|---|---|---|
| 2014/0297091 | A1* | 10/2014 | Itoi | E02F 9/267 701/24 |
| 2018/0218304 | A1* | 8/2018 | Shike | G06Q 10/0631 |
| 2020/0299924 | A1* | 9/2020 | Kurokawa | E02F 9/245 |
| 2021/0301494 | A1* | 9/2021 | Berry | E02F 3/434 |
| 2022/0101552 | A1* | 3/2022 | Kawamoto | G06T 7/11 |
| 2022/0259823 | A1* | 8/2022 | Yoshida | G06Q 50/08 |

FOREIGN PATENT DOCUMENTS

| | | | |
|---|---|---|---|
| CN | 109778939 | A | 5/2019 |
| CN | 109814559 | A | 5/2019 |
| CN | 110318439 | A | 10/2019 |
| CN | 110687872 | A | 1/2020 |
| CN | 111684136 | A | 9/2020 |
| JP | 2020020153 | | 2/2020 |
| WO | WO2019189260 | A1 | 4/2021 |

* cited by examiner

ENGINEERING MACHINERY EQUIPMENT, AND METHOD, SYSTEM, AND STORAGE MEDIUM FOR OPERATION TRAJECTORY PLANNING THEREOF

TECHNICAL FIELD

The present disclosure relates to the field of computer technologies, artificial intelligence, and automatic control and engineering machinery technologies, and particularly relates to an engineering machinery equipment, and a method, system, and storage medium for operation trajectory planning thereof.

BACKGROUND

An engineering machinery equipment is a mechanical operation device applied in engineering construction. The original intention of its design is to improve the engineering operation efficiency and save the manpower costs. However, at present, professional personnel need to be involved in the control over most of the engineering machinery equipment. For example, an excavator and a crane need to be manipulated by a driver to execute a task.

The engineering machinery equipment is intelligentized by automatically manipulating the engineering machinery equipment using an algorithm, which can not only save the manpower costs, but also effectively reduce the risks of personnel being exposed to a harmful environment. A loading material is one of the conventional work types of the engineering machinery equipment. At present, no mature research achievements are available for a planning algorithm of automatic material loading.

SUMMARY

The present disclosure provides an engineering machinery equipment, and a method, system, and storage medium for operation trajectory planning thereof.

According to a first aspect of the present disclosure, a method for operation trajectory planning of an engineering machinery equipment is provided, including: acquiring three-dimensional sensing data of a material pile, to construct a three-dimensional model of the material pile based on the three-dimensional sensing data; determining a loading operation position of the engineering machinery equipment on the material pile based on the three-dimensional model of the material pile and structural design information of the engineering machinery equipment; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

According to a second aspect of the present disclosure, a system for operation trajectory planning of an engineering machinery equipment is provided, including: at least one processor; and a memory communicatively connected to the at least one processor; where the memory stores instructions that can be executed by the at least one processor, and the instructions are executed by the at least one processor, such that the at least one processor executes: acquiring three-dimensional sensing data of a material pile, to construct a three-dimensional model of the material pile based on the three-dimensional sensing data; determining a loading operation position of the engineering machinery equipment on the material pile based on the three-dimensional model of the material pile and structural design information of the engineering machinery equipment; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

According to a third aspect of the present disclosure, an engineering machinery equipment is provided, including: a mechanical structural component and an operation trajectory planning system of the engineering machinery equipment, where the operation trajectory planning system of the engineering machinery equipment includes: at least one processor; and a memory communicatively connected to the at least one processor; where the memory stores instructions that can be executed by the at least one processor, and the instructions are executed by the at least one processor, such that the at least one processor executes: acquiring three-dimensional sensing data of a material pile, to construct a three-dimensional model of the material pile based on the three-dimensional sensing data; determining a loading operation position of the engineering machinery equipment on the material pile based on the three-dimensional model of the material pile and structural design information of the engineering machinery equipment; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

According to a fourth aspect of the present disclosure, a non-transient computer-readable storage medium storing computer instructions is provided, where the computer instructions are used for causing a computer to execute: acquiring three-dimensional sensing data of a material pile, to construct a three-dimensional model of the material pile based on the three-dimensional sensing data; determining a loading operation position of the engineering machinery equipment on the material pile based on the three-dimensional model of the material pile and structural design information of the engineering machinery equipment; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

The technology according to the present disclosure achieves automatic planning of the operation trajectory of the loading operation of the engineering machinery equipment.

It should be understood that contents described in the SUMMARY are neither intended to identify key or important features of embodiments of the present disclosure, nor intended to limit the scope of the present disclosure. Other features of the present disclosure will become readily understood in conjunction with the following description.

BRIEF DESCRIPTION OF THE DRAWINGS

The accompanying drawings are used for better understanding of the present solution, and do not impose a limitation on the present disclosure. In the figures.

DETAILED DESCRIPTION OF EMBODIMENTS

Example embodiments of the present disclosure are described below with reference to the accompanying drawings, including various details of the embodiments of the present disclosure to contribute to understanding, which should be considered merely as examples. Therefore, those of ordinary skills in the art should realize that various alterations and modifications can be made to the embodiments described here without departing from the scope and spirit of the present disclosure. Similarly, for clearness and conciseness, descriptions of well-known functions and structures are omitted in the following description.

The method for operation trajectory planning of an engineering machinery equipment provided by the present disclosure may be applied to a data processing module mounted on the engineering machinery equipment, or may be applied to a remote server terminal, which performs data interaction with the engineering machinery equipment through a communication connection established with the engineering machinery equipment.

Here, the engineering machinery equipment is a heavy or light machinery equipment used in engineering practice, and may include, but is not limited to: mechanical equipment used in earthwork construction engineering, pavement construction and maintenance, mobile crane loading and unloading operations, and various construction engineering, such as an excavator, a bulldozer, a crane, a road roller, a pile driver, and a concrete mixer.

Figure 1:
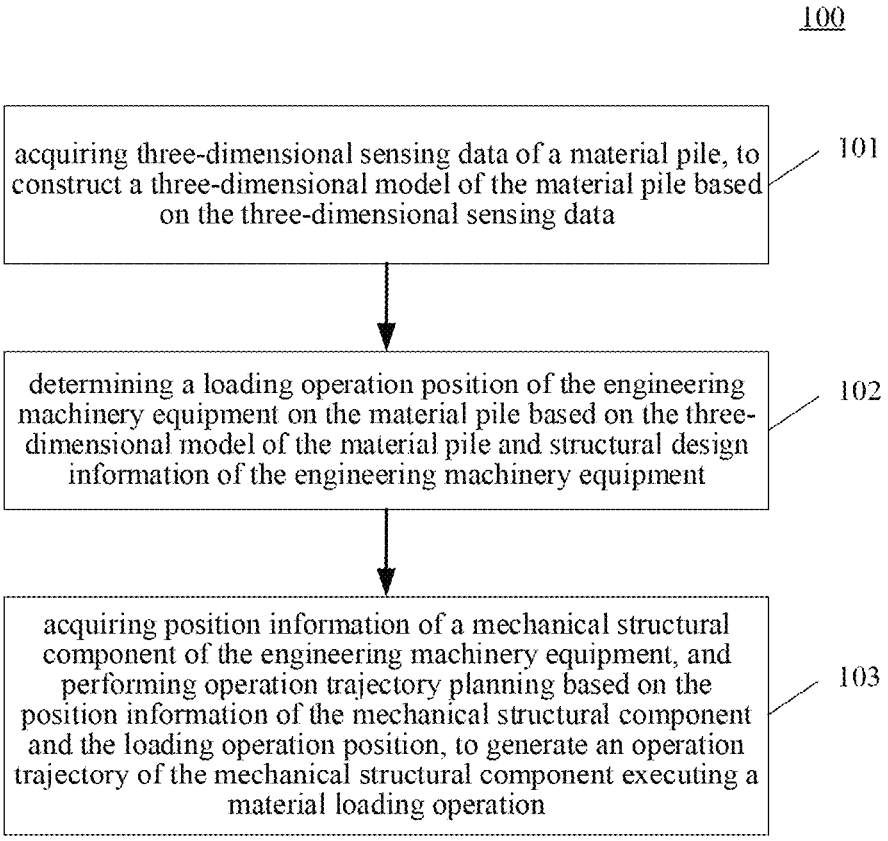
FIG. 1 is a schematic flowchart of a method for operation trajectory planning of an engineering machinery equipment according to an embodiment of the present disclosure.

Referring to FIG. 1, a schematic flowchart of a method for operation trajectory planning of an engineering machinery equipment of an embodiment of the present disclosure is shown. As shown in FIG. 1, a process 100 of the method for operation trajectory planning of an engineering machinery equipment of the present embodiment includes the following steps:

Step 101: acquiring three-dimensional sensing data of a material pile, to construct a three-dimensional model of the material pile based on the three-dimensional sensing data.

In the present embodiment, an executing body of the method for operation trajectory planning of an engineering machinery equipment can acquire the three-dimensional sensing data of the material pile by various approaches. The three-dimensional sensing data is sensing data obtained by a sensor through collecting three-dimensional information of a space, and may include at least one of the following items: image data containing depth information and collected by a depth image sensor, three-dimensional point cloud data collected by a lidar, and the like.

The executing body may obtain the three-dimensional sensing data through a connection established with a three-dimensional information sensor for detecting three-dimensional spatial information within a work area, or obtain the three-dimensional sensing data by sending a data read request to a temporary or permanent storage medium of the three-dimensional information sensor for detecting the three-dimensional spatial information within the work area.

Here, the three-dimensional information sensor for detecting the three-dimensional spatial information within the work area may be provided at a fixed position within the work area, or may be provided on the engineering machinery equipment. It should be noted that a detection area of a single sensor is limited. In order to acquire spatial sensing data that can cover the entire work area, a plurality of three-dimensional information sensors distributed at different positions may be provided. For example, a depth camera may be provided on four sides the engineering machinery equipment respectively, and a lidar may be provided on the top or any side of the engineering machinery equipment.

The material pile is an operation object, e.g., earthwork or other building material piles, of the engineering machinery equipment such as an excavator and a bulldozer. Generally, the material pile presents an irregular shape, and a three-dimensional model of the material pile may be constructed based on the three-dimensional sensing data.

Specifically, three-dimensional coordinates of an edge feature point of the material pile can be determined based on the three-dimensional sensing data, and then a three-dimensional surface of the material pile can be constructed based on dense edge feature points. For example, coordinates of a pixel point of the material pile in an image can be converted into a world coordinate system based on depth image data, in accordance with pre-calibrated camera parameters, and with reference to the depth information. Alternatively, a topographic elevation map of the material pile can be generated through three-dimensional modeling based on dense point clouds obtained by lidar scanning and ranging, for use as the three-dimensional model of the material pile.

Step 102: determining a loading operation position of the engineering machinery equipment on the material pile based on the three-dimensional model of the material pile and structural design information of the engineering machinery equipment.

The structural design information of the engineering machinery equipment includes design parameters, such as a size, a relative position, and a movable range (e.g., a maximum inclination angle), of the mechanical structural component of the engineering machinery equipment. Generally, the engineering machinery equipment consists of a plurality of mechanical structural components. For example, the excavator includes mechanical structural components, such as a chassis (including a crawler belt, or the like), a rotatable vehicle body, a movable arm (or referred as a big arm), a bucket arm, and a bucket.

The loading operation position refers to an operation position of the engineering machinery equipment on the material pile in a single material pile loading operation, such as an excavation position of the excavator. In the present embodiment, the executing body may first determine a preliminary range of the loading operation position of the engineering machinery equipment on the material pile based on the three-dimensional model of the material pile, such as the topographic elevation map of the material pile. For example, a preset height range downward from the top of the material pile being the preliminary range of the loading operation position may be determined based on the topographic elevation map. Then, a position where a structural component of the engineering machinery equipment can reach and can successfully load a certain quantity of material may be selected within the preliminary range of the loading operation based on the structural design information of the engineering machinery equipment and a shape of the material pile, for use as the loading operation position.

Alternatively, in some alternative implementations, an optimal loading operation position on the material pile may be solved using dynamic programming based on the structural design information of the engineering machinery equipment and the three-dimensional model of the material pile.

Alternatively, a machine learning method may be used for simulating a selection of the loading operation position when the engineering machinery equipment is manipulated by a human operator. For example, a training sample is constructed by collecting operation position selection data of the human operator in a material pile loading operation, and associating three-dimensional data of the material pile with the structural design information of the engineering machinery equipment, and is used for training a machine learning model for deciding the loading operation position. And, the trained machine learning model is used for determining the loading operation position.

Step 103: acquiring position information of a mechanical structural component of the engineering machinery equipment, and performing operation trajectory planning based on the position information of the mechanical structural component and the loading operation position, to generate an operation trajectory of the mechanical structural component executing a material loading operation.

Image data of the engineering machinery equipment collected by an image sensor provided within the work area of the engineering machinery equipment can be acquired. By analyzing the image data, and extracting an image area of each mechanical structural component, and based on calibrated camera parameters, pixel point coordinates of the mechanical structural component can be converted into a three-dimensional world coordinate system, thereby obtaining three-dimensional position coordinates of the mechanical structure equipment.

The executing body can perform operation trajectory planning based on the position information of the mechanical structural component and the loading operation position obtained in step 102. Here, the operation trajectory is a motion trajectory of the mechanical structural component, e.g., a trajectory of the mechanical structural component moving from a current position to a specified position, such that the engineering machinery equipment reaches the loading operation position. More specifically, the operation trajectory may be a running trajectory of each joint point of the mechanical structural component, e.g., a running trajectory of each rotatable connection point.

Taking the excavator as an example, a running trajectory of the movable arm can be planned using a planning algorithm, such as dynamic planning, based on the excavation position on the material pile and three-dimensional coordinates of the movable arm of the excavator. After moving to the specified position based on the running trajectory, the movable arm can drive the bucket to the excavation position.

It should be noted that, when planning an operation trajectory of the loading operation, factors such as a structure of the engineering machinery equipment and a power state of the engineering machinery equipment may also be considered, and the operation trajectory of the mechanical structural component may be optimized using an optimization algorithm. For example, it is necessary to ensure that no collision will occur between the mechanical structural components of the engineering machinery equipment, it is necessary to consider whether an oil pressure of a diesel engine that powers the mechanical structural components of the engineering machinery equipment can support the planned operation trajectory, and the like.

In the present embodiment, overall planning may also be performed on operation trajectories of at least two different mechanical structural components of the engineering machinery equipment executing the material loading operation, an operation efficiency of the engineering machinery equipment, a connection and synergic relationship between different mechanical structural components, and the like may be considered during the overall planning, and operation trajectories of different mechanical structural components in a single material loading operation may be planned through a dynamic planning algorithm.

The method for operation trajectory planning of an engineering machinery equipment of the present embodiment acquires three-dimensional sensing data of a material pile, to construct a three-dimensional model of the material pile based on the three-dimensional sensing data, determines a loading operation position of the engineering machinery equipment on the material pile based on the three-dimensional model of the material pile and structural design information of the engineering machinery equipment, acquires position information of a mechanical structural component of the engineering machinery equipment, and performs operation trajectory planning based on the position information of the mechanical structural component and the loading operation position, to generate an operation trajectory of the mechanical structural component executing a material loading operation, thereby achieving automatic planning of the operation trajectory of the loading operation of the engineering machinery equipment. Since this method can automatically acquire the three-dimensional data of the material pile and perform autonomous operation trajectory planning, it is not necessary for a human to determine the operation position of the material pile and adjust the operation trajectory, thereby contributing to improving the operation efficiency.

In some embodiments, the position information of the mechanical structural component of the engineering machinery equipment may be acquired as follows: acquiring an inclination angle of the mechanical structural component sensed by an inclination angle sensor provided on the mechanical structural component; and determining the position information of the mechanical structural component based on a kinematic model of the engineering machinery equipment and the inclination angle of the mechanical structural component.

Specifically, the inclination angle of the mechanical structural component is obtained through an angle sensor mounted on the mechanical structural component of the engineering machinery equipment. Taking the excavator as an example, the angle sensor may be mounted at a position of a rotary shaft, the movable arm, the bucket arm, and the bucket of the excavator. The three-dimensional position coordinates of the mechanical structural component are computed based on the kinematic model of the engineering machinery equipment. Here, the three-dimensional position coordinates of the mechanical structural component may be represented by three-dimensional position coordinates of at least one of an initiating terminal, an end terminal, a center point, or a bending point thereof, or a linear equation characterizing the mechanical structural component may be fitted, e.g., by line fitting, to characterize a three-dimensional position of the mechanical structural component.

Figure 2:
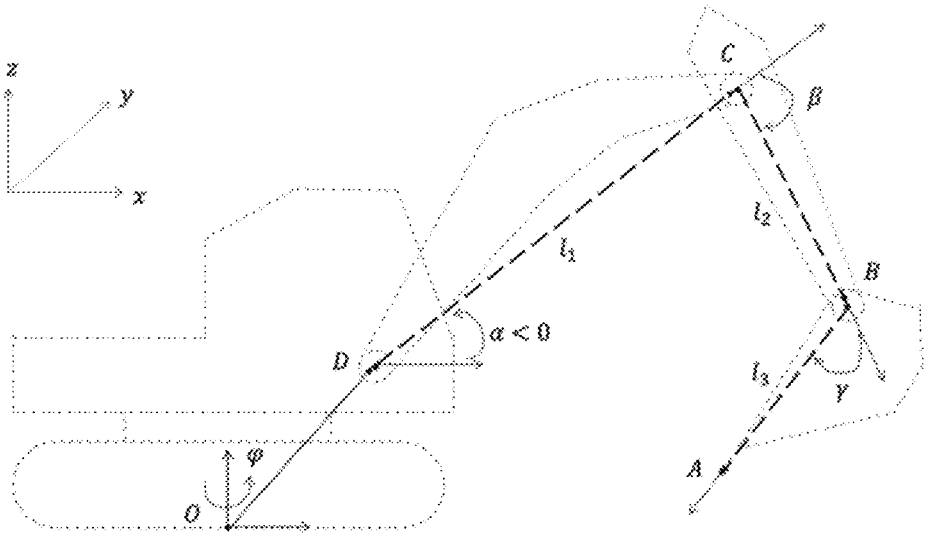
FIG. 2 is a schematic diagram of a kinematic model of the engineering machinery equipment.

FIG. 2 shows a schematic diagram of a kinematic model of the engineering machinery equipment taking an excavator as an example. As shown in FIG. 2, when a vector from a gyration center O of the excavator to a connection point D of a movable arm and a rotatable vehicle body of the excavator, a length $l_1$ of the movable arm, a length $l_2$ of a bucket arm, and a length $l_3$ of a bucket are known, a rotation angle $\varphi$ of the excavator, an inclination angle $\alpha$ of the movable arm, an inclination angle $\beta$ of the bucket arm, and an inclination angle $\gamma$ of the bucket can be measured using inclination angle sensors mounted on the rotatable vehicle body, the movable arm, the bucket arm, and the bucket. Then, three-dimensional coordinates of the connection point D of the movable arm and the rotatable vehicle body of the excavator, a connection point C of the movable arm and the bucket arm, a connection point B of the bucket arm and the bucket, and an end terminal point A of the bucket can be uniquely determined in a coordinate system (O is the origin, and x, y, and Z are coordinate axes) shown in the figure, based on a geometrical relationship.

Based on the kinematic model of the engineering machinery equipment, the position of the mechanical structural component can be quickly and easily sensed by the angle sensor to quickly assist in planning the loading position and the operation trajectory of the loading operation.

In some embodiments, the loading operation position on the material pile can be determined as follows: determining a maximum material loading quantity of the engineering machinery equipment in a single loading operation based on the structural design information of the engineering machinery equipment; and determining the loading operation position on the material pile based on the three-dimensional model of the material pile and the maximum material loading quantity of the engineering machinery equipment in the single loading operation, where a total quantity of loaded material of the engineering machinery equipment when executing the single loading operation on the material pile at the loading operation position does not exceed the maximum material loading quantity.

Specifically, the structural design information of the engineering machinery equipment includes parameters, such as a size, a rotation angle, a load bearing range, and dynamic design, of each mechanical structural component, and the maximum material loading quantity of the engineering machinery equipment in the single loading operation can be computed based on such design information. Here, the maximum material loading quantity is a maximum volume or maximum weight of a loadable material.

Alternatively, the structural design information of the engineering machinery equipment includes size parameters of a loading component (e.g., the bucket of the excavator) therein. Its volume can be computed based on the size parameters of the loading component, and a maximum volume of the loadable material can be further computed based on a volume of the loading component, or an average density of the material pile can be further acquired, and then a maximum weight of the loadable material can be computed.

When planning the loading operation position, the above maximum material loading quantity can be used as a constraint to determine a loading operation position where the total quantity of loaded material in the single loading operation does not exceed the maximum material loading quantity. For example, a plurality of candidate operation positions can be determined based on the three-dimensional model of the material pile and the structural design information of the engineering machinery equipment, and an operation position satisfying the constraint of the maximum material loading quantity can be selected therefrom for use as the loading operation position of the engineering machinery equipment on the material pile. The loading operation position is determined in this way after considering the loading capacity of the engineering machinery equipment, thereby improving the success rate of the engineering machinery equipment executing the loading operation at the loading operation position.

Further, when determining the loading operation position, attention may also be paid to the operation efficiency of the engineering machinery equipment. The overall loading operation can be planned for the overall shape and volume of the material pile. Specifically, the total quantity of loaded material in each loading operation can be planned based on the three-dimensional model of the material pile and a preset operation efficiency constraint. Here, the operation efficiency of the engineering machinery equipment when executing the single loading operation on the material pile at the loading operation position satisfies the preset operation efficiency constraint. The preset operation efficiency constraint is a constraint on overall operating time, operating speed, and the like. For example, in practice, the excavator is required to complete an excavation operation of a material pile within specified time. Alternatively, a shape of the material pile may also be considered, and a model may be used to predict a deformation of the material pile during the loading operation to avoid occurrence of the situation that does not contribute to improving the operation efficiency, such as collapse, of the material pile.

In some embodiments, the mechanical structural component of the engineering machinery equipment includes a displacement component and the loading component. The loading component is connected to the displacement component, and the loading component moves with a pose change of the displacement component. The loading component is a component for loading materials and having a space for accommodating the materials. The loading component, e.g., a bucket, a shovel blade, and the like, can rotate relative to the displacement component. The displacement component, e.g., a movable arm, a lazy arm, and the like, is configured to control the loading component to move in a large range.

When performing operation trajectory planning, a first operation trajectory of moving the loading component to the loading operation position from a position characterized by position information of the displacement component can be generated. That is, the operation trajectory of the mechanical structural component executing the material loading operation may include the first operation trajectory of the displacement component. When moving along the first operation trajectory, the displacement component can drive the loading component to move to the above loading operation position.

Specifically, current position information of a position component can be acquired, and the first operation trajectory of the displacement component can be planned through a dynamic planning algorithm with a position characterized by the current position information as a starting point of the trajectory, and the above loading operation position as an end point of the trajectory, in combination with the structural design information of the displacement component. Alternatively, the first operation trajectory is also required to be planned by avoiding other mechanical structural components based on structural design information of other mechanical structural components of the engineering machinery equipment, to avoid occurrence of collisions between mechanical structures.

Further, a loading operation trajectory of the loading component may also be planned based on the loading operation position, to generate a second operation trajectory of the loading component executing the material loading operation. After moving to the loading operation position along with the displacement component, the loading component can plan the loading operation trajectory of the loading component based on a pose of the loading component. The loading operation trajectory may be a running trajectory of a center point or end terminal of the loading component in the material loading process. When the loading component runs from the loading operation position in accordance with the second operation trajectory, the material is loaded into a loading space of the loading component.

The above method achieves fine planning of operation trajectories of different mechanical structural components in the engineering machinery equipment by planning the first operation trajectory of the displacement component and the second operation trajectory of the loading component, and then the engineering machinery equipment can control the corresponding mechanical structural components respectively based on the fine trajectory planning result, thereby contributing to achieving more accurate control.

Further, when planning the operation trajectory of the mechanical structural component executing the material loading operation, category attribute information and density information of the material pile may also be acquired. The category attribute information indicates a category of the material pile, such as earthwork, concrete, soil, and construction waste. The density information and the category attribute information are used for helping the executing body to plan the operation trajectory of the loading component, which specifically may be planning the loading operation trajectory of the loading component based on the loading operation position, the category attribute information of the material pile, the density information of the material pile, and a preset force range of the loading component executing the loading operation.

The category attribute information and the density information of the material pile can be used for estimating the material weight per unit volume, and can also be used for estimating a force required to load the material per unit volume using a mechanical analysis method. A preset force range of the loading component executing the loading operation is a range of force that can be provided by a power mechanism (e.g., a diesel hydraulic system) of the loading component under the condition of ensuring safety. The executing body can adjust the running trajectory of the loading component, such that the power mechanism of the loading component can, when powering the loading component based on the trajectory, provide enough force to overcome the gravity and other resistances of the material pile, to avoid ineffective operation caused by very high resistances of the material pile and avoid waste of energy (such as a fuel of a hydraulic system) of the power mechanism.

In some embodiments, the method for operation trajectory planning of an engineering machinery equipment may further include: sending, based on the operation trajectory of the mechanical structural component executing the material loading operation and state information of a power mechanism of the mechanical structural component, corresponding power control information to the power mechanism.

The power mechanism of the mechanical structural component is a component that powers the mechanical structural component, e.g., the hydraulic system. The hydraulic system includes a hydraulic pump, a control valve, a hydraulic cylinder, a hydraulic motor, a pipeline, an oil tank, and the like. The state information of the power mechanism refers to state information that affects the magnitude of control force outputted by the power mechanism, e.g., an oil pressure feedback state of the hydraulic system. The oil pressure feedback state can be obtained by monitoring an oil pressure within the hydraulic cylinder. An inclination angle change of the mechanical structural component can be determined based on the operation trajectory of the mechanical structural component executing the material loading operation, and then the power control information can be generated based on the state information of the power structure. Here, the power control information may be control information of a required force provided by the controlled power mechanism when moving in accordance with a corresponding loading operation trajectory, such as an opening size of the control valve in the hydraulic system, and opening time corresponding to the opening size. The executing body may send the power control information to the power mechanism, and the power mechanism adjusts a state based on the power control information, thereby providing a corresponding force to a corresponding mechanical structural component.

By controlling the state of the power mechanism based on the state information of the power mechanism of the mechanical structural component and the determined operation trajectory of the loading operation, the power mechanism provides the corresponding force for the mechanical structural component based on the operation trajectory of the loading operation, thereby realizing intelligentized control of the power mechanism of the engineering machinery equipment, and further realizing running trajectory control of the engineering machinery equipment.

Figure 3:
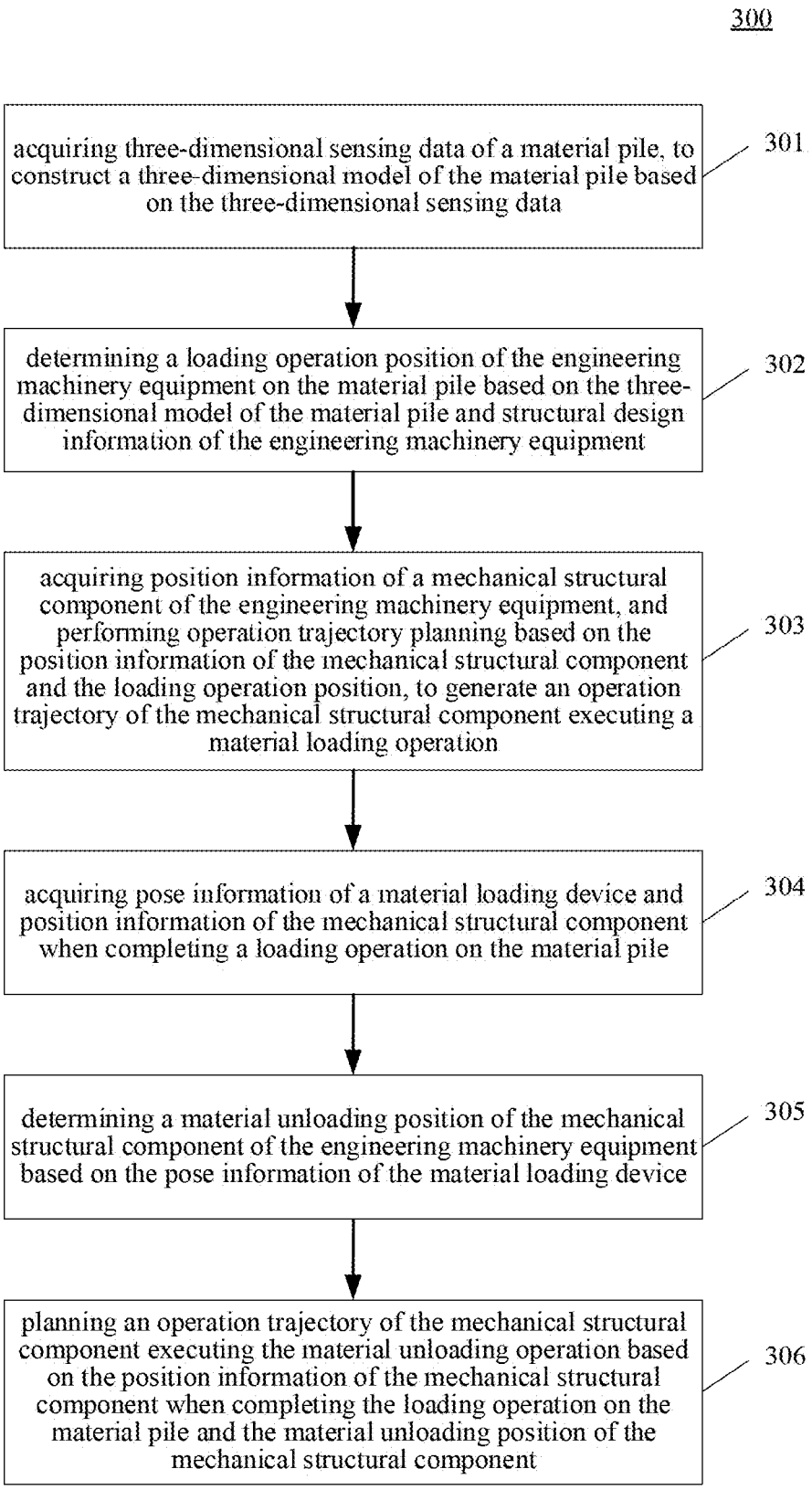
FIG. 3 is a schematic flowchart of the method for operation trajectory planning of an engineering machinery equipment according to another embodiment of the present disclosure.

Further referring to FIG. 3, a schematic flowchart of the method for operation trajectory planning of an engineering machinery equipment of another embodiment of the present disclosure is shown. As shown in FIG. 3, a process 300 of the method for operation trajectory planning of an engineering machinery equipment of the present embodiment includes the following steps:

Step 301: acquiring three-dimensional sensing data of a material pile, to construct a three-dimensional model of the material pile based on the three-dimensional sensing data.

Step 302: determining a loading operation position of the engineering machinery equipment on the material pile based on the three-dimensional model of the material pile and structural design information of the engineering machinery equipment.

Step 303: acquiring position information of a mechanical structural component of the engineering machinery equipment, and performing operation trajectory planning based on the position information of the mechanical structural component and the loading operation position, to generate an operation trajectory of the mechanical structural component executing a material loading operation.

Step 301 to step 303 in the present embodiment are consistent with step 101 to step 103 in the above embodiments. The description will not be repeated here.

Step 304: acquiring pose information of a material loading device and position information of the mechanical structural component when completing a loading operation on the material pile.

The material loading device, e.g., a loading truck, is a device for loading materials that is independent of the engineering machinery equipment. In the present embodiment, the pose information of the material loading device can be obtained by a pose sensing device mounted on the material loading device, e.g., a positioning system mounted on the material loading device. Alternatively, the material loading device can actively transmit position and pose information detected by its own positioning system to the executing body of the method for operation trajectory planning of an engineering machinery equipment. Here, the pose information may include orientation information.

Inclination angle data of the mechanical structural component when completing the loading operation on the material pile may also be acquired through an angle sensor mounted on the mechanical structural component, and then the position information of the mechanical structural component may be computed based on a kinematic model of the engineering machinery equipment.

Step 305: determining a material unloading position of the mechanical structural component of the engineering machinery equipment based on the pose information of the material loading device.

After completing the material loading operation, an unloading position of the material loading device, i.e., the material unloading position of the mechanical structural component of the engineering machinery equipment, can be determined based on the pose information of the material loading device. The material unloading position of the mechanical structural component is a position of a loading area of the material loading device, such as a carriage position of the loading truck. In the present embodiment, the unloading position can be planned based on the pose information (e.g., carriage orientation) and the position information of the material loading device.

Alternatively, the material unloading position of the mechanical structural component of the engineering machinery equipment can be planned using a machine learning algorithm by simulating an unloading position selecting behavior during manual operation. Specifically, a machine learning model for planning the unloading position can be trained by collecting the unloading position selected during manual operation, and the position and pose data of the material loading device with respect to the engineering machinery equipment in an unloading scenario. Then, an appropriate unloading position can be selected using the trained machine learning model during unloading trajectory planning.

Step 306: planning an operation trajectory of the mechanical structural component executing the material unloading operation based on the position information of the mechanical structural component when completing the loading operation on the material pile and the material unloading position of the mechanical structural component.

With the position information of the mechanical structural component when completing the loading operation on the material pile as position information of a starting point, and the material unloading position of the mechanical structural component as position information of an end point, an operation trajectory of the mechanical structural component transporting a material from the starting point to the end point may be used as the operation trajectory of the mechanical structural component executing the unloading operation.

Obstacle detection can be performed based on image or point cloud information of a work area of the engineering machinery equipment, and obstacle avoidance can be performed using an obstacle avoidance algorithm when planning the operation trajectory, and the operation trajectory of the mechanical structural component executing the unloading operation can be generated. After running to the unloading position in accordance with the operation trajectory, the mechanical structural component can unload a loaded material to complete the material transfer operation.

The method of the present embodiment can further automatically plan the operation trajectory of the material unloading operation by acquiring the pose information of the material loading device and the position information of the mechanical structural component of the engineering machinery equipment when completing the loading operation, thereby completing planning of the complete trajectory of the material loading and unloading processes.

In some embodiments, the pose information of the material loading device can be determined as follows: acquiring spatial sensing data of the work area of the engineering machinery equipment, and performing object detection based on the spatial sensing data to determine the pose information of the material loading device.

A spatial sensor is a sensor that collects spatial information to generate data, such as an image, a point cloud, and a three-dimensional model. Image data and/or point cloud data of the material loading device can be collected through the spatial sensor, and target detection on the image data and/or point cloud data can be performed, to detect a position of the material loading device, and convert the position into a three-dimensional world coordinate system, thus obtaining three-dimensional pose information of the material loading device. Alternatively, the position and pose information of the material loading device can be detected using an algorithm such as deep learning detection with reference to depth image data and three-dimensional point cloud data of the material loading device. Thus, the three-dimensional model of the material pile can be constructed and the pose information of the material loading device can be extracted respectively based on the information collected by the spatial sensor, thus effectively utilizing acquired spatial sensing information.

In some embodiments, the above process 300 of the method further includes the following step: acquiring loading state information of the material loading device. The loading state information of the material loading device may include a quantity of loaded material of the material loading device and a position of the loaded material, and can be obtained based on analysis of the spatial sensing data such as the image and the point cloud. In this case, the material unloading position of the mechanical structural component of the engineering machinery equipment can be determined based on the pose information and the loading state information of the material loading device.

Specifically, an area with an unloaded material or an area with a small quantity of loaded material in a loading space of the material loading device can be selected based on a preset rule, for use as the material unloading position of the mechanical structural component. When selecting the material unloading position, it is also necessary to estimate whether the material will overflow the loading space of the material loading device when the loaded material in the engineering machinery equipment is unloaded into the material loading device at the material unloading position, and reselect the material unloading position when the material is estimated to be likely to overflow the loading space, to further enhance the reliability of the loading operation.

Alternatively, the loading state information includes distribution information of the loaded material within the loading space. The distribution information of the loaded material within the loading space can be extracted through image analysis of data such as the image or the point cloud collected from the loading space of the material loading device. Then, the material unloading position of the mechanical structural component of the engineering machinery equipment is determined based on the pose information of the loading device and the distribution information of the loaded material within the loading space, and in accordance with a preset unloaded material distribution strategy. The preset unloaded material distribution strategy is a strategy for controlling the distribution of unloading positions or the distribution of the unloaded material, e.g., an average unloading strategy, or an unloaded material distribution strategy that is preset based on weight capacities of different areas of the material loading device. Based on distribution information of a currently loaded material in the loading space, an unloading position satisfying the preset unloaded material distribution strategy after unloading the currently loaded material in the engineering machinery equipment can be selected for use as the material unloading position of the mechanical structural component of the engineering machinery equipment.

Thus, the material unloading position can be reasonably planned based on the preset unloaded material distribution strategy to avoid non-uniform material loading within the loading space of the material loading device, or the material in a certain area of the loading space of the material loading device exceeding a loading capacity of the area, while the material in other areas failing to reach a maximum load, thereby resulting in losses of the material loading device.

In some embodiments, the above process 300 of the method further includes: sending, based on the operation trajectory of the mechanical structural component executing the material unloading operation and state information of a power mechanism of the mechanical structural component, corresponding power control information to the power mechanism.

As described in the above embodiments, the power mechanism of the mechanical structural component is a component that powers the mechanical structural component. After determining the operation trajectory of the mechanical structural component executing the material unloading operation, an inclination angle change of the mechanical structural component corresponding to the operation trajectory can be determined, and then the corresponding power control information can be generated based on the state information of the power mechanism. Here, the power control information may be control information of a required force provided by the controlled power mechanism when moving in accordance with a corresponding unloading operation trajectory. The executing body may send the power control information to the power mechanism, and the power mechanism adjusts a state based on the power control information, thereby providing a corresponding force to a corresponding mechanical structural component.

By controlling the state of the power mechanism based on the state information of the power mechanism of the mechanical structural component and the determined operation trajectory of the unloading operation, the power mechanism provides the corresponding force for the mechanical structural component based on the operation trajectory of the unloading operation, thereby further improving intelligentized control of the power mechanism of the engineering machinery equipment throughout the loading operation process.

In some embodiments, when determining that the material loading device reaches a maximum loading capacity based on the loading state information, control information for controlling the mechanical structural component to stop operation is sent to the power mechanism of the mechanical structural component.

During the operation of the engineering machinery equipment, the above process 300 of the method can be repeated multiple times. Because a shape of the material pile will change after each loading operation of the engineering machinery equipment, three-dimensional information of the material pile can be resensed, the three-dimensional model of the material pile can be reconstructed, and the operation position of the loading operation can be determined during each loading operation. During each unloading operation, the loading state information of the material loading device can also be resensed, and the material unloading position can be reselected accordingly. When it is determined based on the spatial sensing data of the material loading device that the material loading device has reached the maximum loading capacity, it is necessary to control the engineering machinery equipment to stop unloading the material to the material loading device, i.e., to stop a current operation task of the engineering machinery equipment. In this case, control information for controlling the mechanical structural component of the engineering machinery equipment to stop operation can be sent to the power mechanism of the mechanical structural component. For example, a control valve in a hydraulic system sends a switch-off command to cut off power of each mechanical structural component, and control each mechanical structural component to stop operation. Thus, the loading operation and the unloading operation can be automatically stopped when the material loading device reaches its full capacity.

Figure 4:
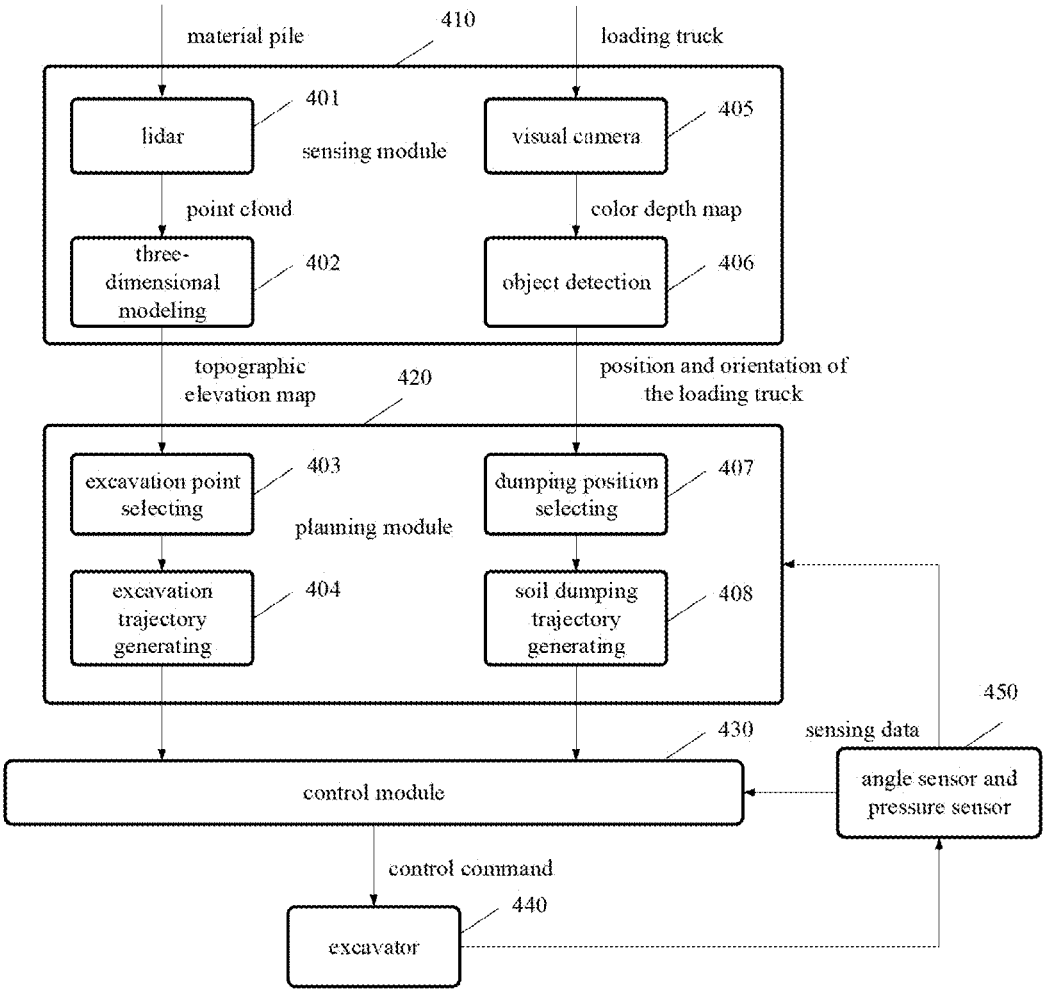
FIG. 4 is a schematic diagram of the method for operation trajectory planning of an engineering machinery equipment according to an implementation process of the present disclosure.

Referring to FIG. 4, another schematic diagram of the method for operation trajectory planning of an engineering machinery equipment according to an implementation process of the present disclosure is shown. In FIG. 4, an excavator executing an excavation task and unloading a material to a loading truck is taken as an example.

As shown in FIG. 4, first, a sensing module 410 acquires a point cloud of a material pile through a lidar 401, obtains a topographic elevation map of the material pile by three-dimensional modeling 402 based on the point cloud; can also obtain a color depth map by sensing the loading truck using a visual camera 405, and performs object detection 406 on the color depth map to obtain a position and orientation of the loading truck. Then, a planning module 420 executes excavation point selecting 403 and excavation trajectory generating 404 based on the topographic elevation map of the material pile generated by the sensing module 410, and dumping position selecting 407 and soil dumping trajectory generating 408 based on the position and orientation of the loading truck sensed by the sensing module 410. A control module 430 acquires a planning result of the planning module 420, obtains sensing data sensed by an angle sensor 450 at a position, such as a movable arm, and a bucket, and by a pressure sensor 450 provided in a hydraulic system, and sends a corresponding control command to the hydraulic system of the excavator 440. When planning the trajectory, selecting the excavation point, and selecting the soil dumping position, the planning module 420 can also perform dynamic planning with the sensing data of the angle sensor and the pressure sensor 450 as auxiliary information.

Figure 5:
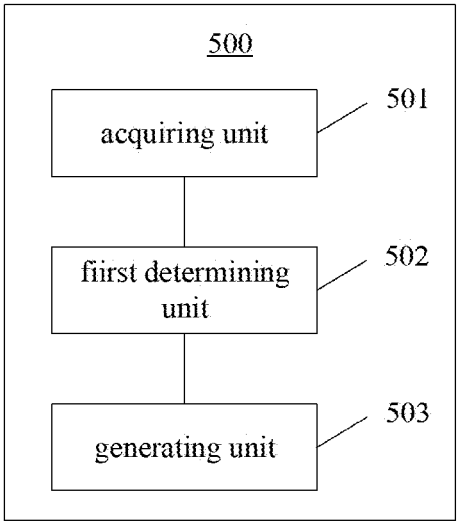
FIG. 5 is a block diagram of an apparatus for operation trajectory planning of an engineering machinery equipment according to an embodiment of the present disclosure.

Referring to FIG. 5, as an implementation of the method for operation trajectory planning of an engineering machinery equipment, an embodiment of the present disclosure provides an apparatus for operation trajectory planning of an engineering machinery equipment. The embodiment of the apparatus corresponds to the above embodiments of the method. The apparatus may be specifically applied to various electronic devices.

As shown in FIG. 5, the apparatus 500 for operation trajectory planning of an engineering machinery equipment of the present embodiment includes: a first acquiring unit 501, a first determining unit 502, and a generating unit 503. The first acquiring unit 501 is configured to acquire three-dimensional sensing data of a material pile, to construct a three-dimensional model of the material pile based on the three-dimensional sensing data; the first determining unit 502 is configured to determine a loading operation position of the engineering machinery equipment on the material pile based on the three-dimensional model of the material pile and structural design information of the engineering machinery equipment; and the generating unit 503 is configured to acquire position information of a mechanical structural component of the engineering machinery equipment, and perform operation trajectory planning based on the position information of the mechanical structural component and the loading operation position, to generate an operation trajectory of the mechanical structural component executing a material loading operation.

In some embodiments, the first determining unit 502 is configured to determine a loading operation position on the material pile as follows: determining a maximum material loading quantity of the engineering machinery equipment in a single loading operation based on the structural design information of the engineering machinery equipment; and determining the loading operation position on the material pile based on the three-dimensional model of the material pile and the maximum material loading quantity of the engineering machinery equipment in the single loading operation, where a total quantity of loaded material of the engineering machinery equipment when executing the single loading operation on the material pile at the loading operation position does not exceed the maximum material loading quantity.

In some embodiments, an operation efficiency of the engineering machinery equipment when executing the single loading operation on the material pile at the loading operation position satisfies the preset operation efficiency constraint.

In some embodiments, the mechanical structural component includes a displacement component and a loading component, the loading component is connected to the displacement component, and the loading component moves with a pose change of the displacement component. The generating unit 503 is configured to generate the operation trajectory of the mechanical structural component executing the material loading operation as follows: generating a first operation trajectory of moving the loading component to the loading operation position from a position characterized by position information of the displacement component.

In some embodiments, the generating unit 503 is configured to: plan a loading operation trajectory of the loading component based on the loading operation position, to generate a second operation trajectory of the loading component executing the material loading operation.

In some embodiments, the generating unit 503 is configured to: acquire category attribute information and density information of the material pile; and plan the loading operation trajectory of the loading component based on the loading operation position, the category attribute information of the material pile, the density information of the material pile, and a preset force range of the loading component executing the loading operation.

In some embodiments, the apparatus further includes: a first sending unit configured to send, based on the operation trajectory of the mechanical structural component executing the material loading operation and state information of a power mechanism of the mechanical structural component, corresponding power control information to the power mechanism.

In some embodiments, the apparatus further includes: a positioning unit configured to acquire pose information of a material loading device and position information of the mechanical structural component when completing a loading operation on the material pile; a second determining unit configured to determine a material unloading position of the mechanical structural component of the engineering machinery equipment based on the pose information of the material loading device; and a planning unit configured to plan an operation trajectory of the mechanical structural component executing the material unloading operation based on the position information of the mechanical structural component when completing the loading operation on the material pile and the material unloading position of the mechanical structural component.

In some embodiments, the apparatus further includes: a second acquiring unit configured to acquire loading state information of the material loading device; and the second determining unit is further configured to determine the material unloading position of the mechanical structural component of the engineering machinery equipment based on the pose information and the loading state information of the material loading device.

In some embodiments, the loading state information includes distribution information of the loaded material within a loading space; and the second determining unit is further configured to determine the material unloading position of the mechanical structural component of the engineering machinery equipment based on the pose information of the loading device and the distribution information of the loaded material within the loading space, and in accordance with a preset unloaded material distribution strategy.

In some embodiments, the positioning unit is configured to acquire the pose information of the material loading device as follows: acquiring spatial sensing data of the work area of the engineering machinery equipment, and performing object detection based on the spatial sensing data to determine the pose information of the material loading device.

In some embodiments, the apparatus further includes: a second sending unit configured to send, based on the operation trajectory of the mechanical structural component executing the material unloading operation and state information of the power mechanism of the mechanical structural component, corresponding power control information to the power mechanism.

In some embodiments, the apparatus further includes: a controlling unit configured to send, in response to determining that the material loading device reaches a maximum loading capacity based on the loading state information, control information for controlling the mechanical structural component to stop operation to the power mechanism of the mechanical structural component.

In some embodiments, the first acquiring unit 501 is configured to acquire the position information of the mechanical structural component of the engineering machinery equipment as follows: acquiring an inclination angle of the mechanical structural component sensed by an inclination angle sensor provided on the mechanical structural component; and determining the position information of the mechanical structural component based on a kinematic model of the engineering machinery equipment and the inclination angle of the mechanical structural component.

The apparatus 500 corresponds to steps in the above embodiments of the method. Therefore, the operations, features, and achieved technical effects described above for the method for operation trajectory planning of an engineering machinery equipment also apply to the apparatus 500 and the units included therein. The description will not be repeated here.

According to an embodiment of the present disclosure, the present disclosure further provides a system and a readable storage medium for operation trajectory planning of an engineering machinery equipment.

Figure 6:
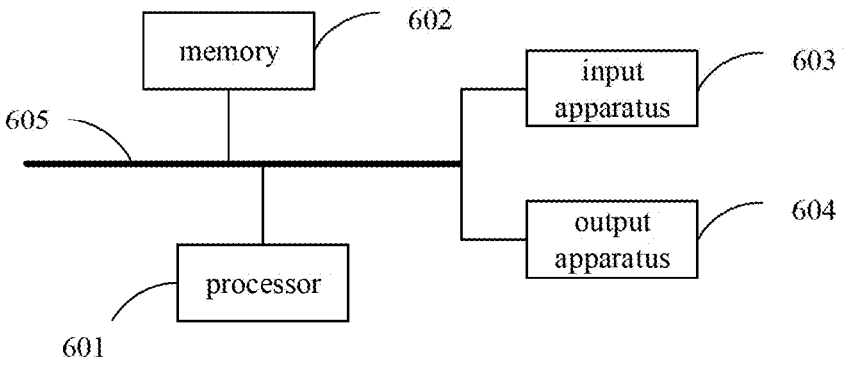
FIG. 6 is a block diagram of a system for operation trajectory planning of an engineering machinery equipment according to an embodiment of the present disclosure.

As shown in FIG. 6, a block diagram of a system for operation trajectory planning of an engineering machinery equipment according to an embodiment of the present disclosure is shown. The system for operation trajectory planning of an engineering machinery equipment is intended to represent various forms of digital computers, such as a laptop computer, a desktop computer, a workbench, a personal digital assistant, a server, a blade server, a mainframe computer, and other suitable computers. The electronic device may also represent various forms of mobile apparatuses, such as a personal digital assistant, a cellular phone, a smart phone, a wearable device, and other similar computing apparatuses. The components shown herein, the connections and relationships thereof, and the functions thereof are used as examples only, and are not intended to limit implementations of the present disclosure described and/or claimed herein.

As shown in FIG. 6, the system for operation trajectory planning of an engineering machinery equipment includes: one or more processors 601, a memory 602, and interfaces for connecting various components, including a high-speed interface and a low-speed interface. The various components are interconnected using different buses, and may be mounted on a common motherboard or in other manners as required. The processor can process instructions for execution within the electronic device, including instructions stored in the memory or on the memory to display graphical information for a GUI on an external input/output apparatus (e.g., a display device coupled to an interface). In other embodiments, a plurality of processors and/or a plurality of buses may be used, as appropriate, along with a plurality of memories. Similarly, a plurality of electronic devices may be connected, with each device providing portions of necessary operations (e.g., as a server array, a group of blade servers, or a multi-processor system). In FIG. 6, a processor 601 is taken as an example.

The memory 602 is a non-transient computer-readable storage medium provided by the present disclosure. The memory stores instructions that can be executed by at least one processor, such that the at least one processor executes the method for operation trajectory planning of an engineering machinery equipment provided by the present disclosure. The non-transient computer-readable storage medium of the present disclosure stores computer instructions. The computer instructions are used for causing a computer to execute the method for operation trajectory planning of an engineering machinery equipment provided by the present disclosure.

As a non-transient computer-readable storage medium, the memory 602 may be configured to store non-transient software programs, non-transient computer-executable programs and modules, such as the program instructions/modules (e.g., the first acquiring unit 501, the first determining unit 502, and the generating unit 503 shown in FIG. 5) corresponding to the method for operation trajectory planning of an engineering machinery equipment in some embodiments of the present disclosure. The processor 601 runs the non-transient software programs, the instructions, and the modules stored in the memory 602, so as to execute various function applications and data processing of the server, i.e., implementing the method for operation trajectory planning of an engineering machinery equipment in the above embodiments of the method.

The memory 602 may include a program storage area and a data storage area, where the program storage area may store an operating system and an application program required by at least one function; and the data storage area may store, e.g., data created based on use of the system for operation trajectory planning of an engineering machinery equipment. In addition, the memory 602 may include a high-speed random access memory, and may further include a non-transient memory, such as at least one magnetic disk storage component, a flash memory component, or other non-transient solid state storage components. In some embodiments, the memory 602 alternatively includes memories configured remotely relative to the processor 601, and these remote memories may be connected to the system for operation trajectory planning of an engineering machinery equipment via a network. Examples of the above network include, but are not limited to, the Internet, an intranet, a local area network, a mobile communication network, and a combination thereof.

The system for operation trajectory planning of an engineering machinery equipment may further include: an input apparatus 603 and an output apparatus 604. The processor 601, the memory 602, the input apparatus 603, and the output apparatus 604 may be connected through a bus or in other manners. A connection through a bus 605 is taken as an example in FIG. 6.

The input apparatus 603 can receive inputted number or character information, and generate a key signal input related to user settings and function control of the system for operation trajectory planning of an engineering machinery equipment, e.g., an input apparatus such as a touch screen, a keypad, a mouse, a trackpad, a touchpad, an indicating arm, one or more mouse buttons, a trackball, and a joystick. The output apparatus 604 may include a display device, an auxiliary lighting apparatus (e.g., an LED), a haptic feedback apparatus (e.g., a vibration motor), and the like. The display device may include, but is not limited to, a liquid crystal display (LCD), a light emitting diode (LED) display, and a plasma display. In some embodiments, the display device may be a touch screen.

Further, the system for operation trajectory planning of an engineering machinery equipment may further include a spatial data sensor. The spatial data sensor may be one of the above input apparatuses 603. The spatial data sensor collects spatial sensing data of the work area of the engineering machinery equipment, and may further transmit the collected spatial sensing data to the processor 601 through the bus 605.

Various embodiments of the systems and technologies described herein may be implemented in a digital electronic circuit system, an integrated circuit system, an ASIC (application specific integrated circuit), computer hardware, firmware, software, and/or a combination thereof. The various embodiments may include: implementation in one or more computer programs that are executable and/or interpretable on a programmable system including at least one programmable processor, which may be a special purpose or general purpose programmable processor, and may receive data and instructions from, and transmit data and instructions to, a storage system, at least one input apparatus, and at least one output apparatus.

These computing programs (also known as programs, software, software applications, or code) include machine instructions for a programmable processor, and may be implemented in a high-level procedural and/or object-oriented programming language, and/or in an assembly/machine language. As used herein, the terms "machine-readable medium" and "computer-readable medium" refer to any computer program product, device, and/or apparatus (e.g., a magnetic disk, an optical disk, a memory, or a programmable logic device (PLD)) configured to provide machine instructions and/or data to a programmable processor, and include a machine-readable medium receiving machine instructions as machine-readable signals. The term "machine-readable signal" refers to any signal used to provide machine instructions and/or data to a programmable processor.

To provide interaction with a user, the systems and technologies described herein can be implemented on a computer that is provided with: a display apparatus (e.g., a CRT (cathode ray tube) or a LCD (liquid crystal display) monitor) for displaying information to the user); and a keyboard and a pointing apparatus (e.g., a mouse or a trackball) by which the user can provide an input to the computer. Other kinds of apparatus may also be used to provide interaction with the user. For example, the feedback provided to the user may be any form of sensory feedback (e.g., visual feedback, auditory feedback, or haptic feedback); and may receive an input from the user in any form (including an acoustic input, a voice input, or a tactile input).

The systems and technologies described herein may be implemented in a computing system that includes a back-end component (for example, as a data server), or a computing system that includes a middleware component (for example, an application server), or a computing system that includes a front-end component (for example, a user computer with a graphical user interface or a web browser through which the user can interact with an implementation of the systems and technologies described herein), or a computing system that includes any combination of such a back-end component, such a middleware component, or such a front-end component. The components of the system may be interconnected by any form or medium of digital data communication (e.g., a communication network). Examples of the communication network include: a local area network (LAN), a wide area network (WAN), and the Internet.

The computer system may include a client terminal and a server. The client terminal may be, but is not limited to, a smart phone, a tablet computer, a notebook computer, a desktop computer, a smart speaker, a smart watch, and the like. The server may be a stand-alone physical server, or may be a server cluster or a distributed system composed of a plurality of physical servers, or may be a cloud server that provides a basic cloud computing service, such as cloud computing, a cloud service, a cloud database, and cloud storage. The client terminal and the server are generally remote from each other, and usually interact through a communication network. The relationship of the client terminal and the server arises by virtue of computer programs that run on corresponding computers and have a client-server relationship with each other.

Figure 7:
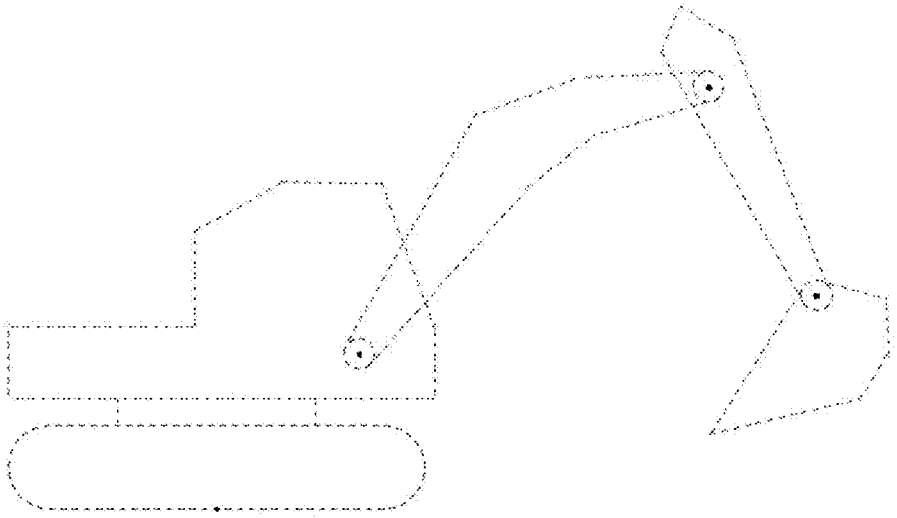
FIG. 7 is a schematic diagram of the engineering machinery equipment according to an embodiment of the present disclosure.

In addition, the embodiments of the present disclosure further provide an engineering machinery equipment. FIG. 7 shows an example of the engineering machinery equipment taking an excavator as an example. The engineering machinery equipment includes a mechanical structural component and an operation trajectory planning system of the engineering machinery equipment. The operation trajectory planning system of the engineering machinery equipment here may be the above system for operation trajectory planning of an engineering machinery equipment described with reference to FIG. 7. The mechanical structural component is a mechanical component constituting the engineering machinery equipment. For example, the excavator includes: a rotatable vehicle body, a movable arm, a bucket arm, a bucket, a crawler belt, and the like. The operation trajectory planning system of the engineering machinery equipment can sense a working environment of the engineering machinery equipment, and control a safe operation range of the engineering machinery equipment.

The technical solutions according to the embodiments of the present disclosure achieve automatic planning of the loading operation trajectory through three-dimensional modeling of the material pile.

It should be understood that the various forms of processes shown above can be used to reorder, add, or delete steps. For example, the steps described in the present disclosure can be executed in parallel, sequentially, or in different orders, as long as the desired results of the technical solutions disclosed in the present disclosure can be achieved. This is not limited herein.

The above specific embodiments do not constitute a limitation to the protection scope of the present disclosure. It should be understood by those skilled in the art that various modifications, combinations, sub-combinations, and substitutions may be made according to the design requirements and other factors. Any modification, equivalent replacement, improvement, and the like made within the spirit and principle of the present disclosure should be included within the protection scope of the present disclosure.

What is claimed is:

1. A method for operation trajectory planning of an engineering machinery equipment, comprising:

acquiring three-dimensional sensing data of a material pile, to construct a three-dimensional model of the material pile based on the three-dimensional sensing data;

determining a maximum material loading quantity of the engineering machinery equipment in a single loading operation based on the structural design information of the engineering machinery equipment;

determining the loading operation position on the material pile based on the three-dimensional model of the material pile and the maximum material loading quantity of the engineering machinery equipment in the single loading operation, wherein a total quantity of loaded material of the engineering machinery equipment when executing the single loading operation on the material pile at the loading operation position does not exceed the maximum material loading quantity; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

2. The method according to claim 1, wherein an operation efficiency of the engineering machinery equipment when executing the single loading operation on the material pile at the loading operation position satisfies a preset operation efficiency constraint.

3. The method according to claim 1, wherein the mechanical structural component comprises a displacement component and a loading component, the loading component is connected to the displacement component, and the loading component moves with a pose change of the displacement component; and the performing operation trajectory planning based on the position information of the mechanical structural component and the loading operation position, to generate an operation trajectory of the mechanical structural component executing a material loading operation comprises:

generating a first operation trajectory of moving the loading component to the loading operation position from a position characterized by position information of the displacement component.

4. The method according to claim 3, wherein the performing operation trajectory planning based on the position information of the mechanical structural component and the loading operation position, to generate an operation trajectory of the mechanical structural component executing a material loading operation further comprises:

planning a loading operation trajectory of the loading component based on the loading operation position, to generate a second operation trajectory of the loading component executing the material loading operation.

5. The method according to claim 4, wherein the performing operation trajectory planning based on the position information of the mechanical structural component and the loading operation position, to generate an operation trajectory of the mechanical structural component executing a material loading operation further comprises:

acquiring category attribute information and density information of the material pile; and the planning a loading operation trajectory of the loading component based on the loading operation position comprises:

planning the loading operation trajectory of the loading component based on the loading operation position, the category attribute information of the material pile, the density information of the material pile, and a preset force range of the loading component executing the loading operation.

6. The method according to claim 1, wherein the method further comprises:

sending, based on the operation trajectory of the mechanical structural component executing the material loading operation and state information of a power mechanism of the mechanical structural component, corresponding power control information to the power mechanism.

7. The method according to claim 1, wherein the method further comprises:

acquiring pose information of a material loading device and position information of the mechanical structural component when completing a loading operation on the material pile;

determining a material unloading position of the mechanical structural component of the engineering machinery equipment based on the pose information of the material loading device; and planning an operation trajectory of the mechanical structural component executing the material unloading operation based on the position information of the mechanical structural component when completing the loading operation on the material pile and the material unloading position of the mechanical structural component.

8. The method according to claim 7, wherein the method further comprises:

acquiring loading state information of the material loading device; and wherein the determining a material unloading position of the mechanical structural component of the engineering machinery equipment based on the pose information of the material loading device comprises:

determining the material unloading position of the mechanical structural component of the engineering machinery equipment based on the pose information and the loading state information of the material loading device.

9. The method according to claim 8, wherein the loading state information comprises distribution information of the loaded material within a loading space; and the determining the material unloading position of the mechanical structural component of the engineering machinery equipment based on the pose information and the loading state information of the material loading device comprises:

determining the material unloading position of the mechanical structural component of the engineering machinery equipment based on the pose information of the loading device and the distribution information of the loaded material within the loading space, and in accordance with a preset unloaded material distribution strategy.

10. The method according to claim 8, wherein the method further comprises:

sending, in response to determining that the material loading device reaches a maximum loading capacity based on the loading state information, control information for controlling the mechanical structural component to stop operation to a power mechanism of the mechanical structural component.

11. The method according to claim 7, wherein the acquiring pose information of the material loading device comprises:

acquiring spatial sensing data of a work area of the engineering machinery equipment, and performing object detection based on the spatial sensing data to determine the pose information of the material loading device.

12. The method according to claim 7, wherein the method further comprises:

sending, based on the operation trajectory of the mechanical structural component executing the material unloading operation and state information of a power mechanism of the mechanical structural component, corresponding power control information to the power mechanism.

13. The method according to claim 1, wherein the acquiring position information of a mechanical structural component of the engineering machinery equipment comprises:

acquiring an inclination angle of the mechanical structural component sensed by an inclination angle sensor provided on the mechanical structural component; and determining the position information of the mechanical structural component based on a kinematic model of the engineering machinery equipment and the inclination angle of the mechanical structural component.

14. A system for operation trajectory planning of an engineering machinery equipment, comprising:

at least one processor; and a memory communicatively connected to the at least one processor; wherein the memory stores instructions that, when executed by the at least one processor, cause the at least one processor to:

acquire three-dimensional sensing data of a material pile, to construct a three-dimensional model of the material pile based on the three-dimensional sensing data;

determining a maximum material loading quantity of the engineering machinery equipment in a single loading operation based on the structural design information of the engineering machinery equipment;

determining the loading operation position on the material pile based on the three-dimensional model of the material pile and the maximum material loading quantity of the engineering machinery equipment in the single loading operation, wherein a total quantity of loaded material of the engineering machinery equipment when executing the single loading operation on the material pile at the loading operation position does not exceed the maximum material loading quantity; and acquire position information of a mechanical structural component of the engineering machinery equipment, and perform operation trajectory planning based on the position information of the mechanical structural component and the loading operation position, to generate an operation trajectory of the mechanical structural component executing a material loading operation.

15. The system according to claim 14, wherein the system further comprises: a spatial data sensor, the spatial data sensor collecting spatial sensing data of a work area of the engineering machinery equipment.

16. An engineering machinery equipment, comprising:

a mechanical structural component and an operation trajectory planning system;

wherein the operation trajectory planning system of the engineering machinery equipment comprises: at least one processor; and a memory communicatively connected to the at least one processor; and wherein the memory stores instructions that, when executed by the at least one processor, cause the at least one processor to:

acquire three-dimensional sensing data of a material pile, to construct a three-dimensional model of the material pile based on the three-dimensional sensing data;

determining a maximum material loading quantity of the engineering machinery equipment in a single loading operation based on the structural design information of the engineering machinery equipment;

determining the loading operation position on the material pile based on the three-dimensional model of the material pile and the maximum material loading quantity of the engineering machinery equipment in the single loading operation, wherein a total quantity of loaded material of the engineering machinery equipment when executing the single loading operation on the material pile at the loading operation position does not exceed the maximum material loading quantity; and acquire position information of a mechanical structural component of the engineering machinery equipment, and perform operation trajectory planning based on the position information of the mechanical structural component and the loading operation position, to generate an operation trajectory of the mechanical structural component executing a material loading operation.

17. A non-transitory computer-readable storage medium storing computer instructions, wherein the computer instructions cause a computer to execute a method comprising:

acquiring three-dimensional sensing data of a material pile, to construct a three-dimensional model of the material pile based on the three-dimensional sensing data;

determining a maximum material loading quantity of the engineering machinery equipment in a single loading operation based on the structural design information of the engineering machinery equipment;

determining the loading operation position on the material pile based on the three-dimensional model of the material pile and the maximum material loading quantity of the engineering machinery equipment in the single loading operation, wherein a total quantity of loaded material of the engineering machinery equipment when executing the single loading operation on the material pile at the loading operation position does not exceed the maximum material loading quantity; and acquiring position information of a mechanical structural component of the engineering machinery equipment, and performing operation trajectory planning based on the position information of the mechanical structural component and the loading operation position, to generate an operation trajectory of the mechanical structural component executing a material loading operation.

* * * * *